US006065641A

United States Patent [19]

Laguna Valderrama

[11] Patent Number: 6,065,641

[45] Date of Patent: May 23, 2000

[54] CARTRIDGE CONTAINING TWO LIQUIDS

[75] Inventor: José M. Laguna Valderrama, Barcelona, Spain

[73] Assignee: Laboratorios Inibsa, S.A., Barcelona, Spain

[21] Appl. No.: 09/115,288

[22] Filed: Jul. 14, 1998

[30] Foreign Application Priority Data

Jul. 16, 1997 [ES] Spain ..... 9702020

[51] Int. Cl.[7] ..... B67D 5/00

[52] U.S. Cl. ..... 222/80; 222/129; 222/153.14; 222/630; 222/83; 206/219; 206/222

[58] Field of Search ..... 222/630, 83, 129, 222/395, 153.14, 153.07; 206/219, 222

[56] References Cited

U.S. PATENT DOCUMENTS

| | | | |
|---|---|---|---|
| 2,559,231 | 7/1951 | Seemar | 206/222 |
| 3,404,811 | 10/1968 | Cernei | 206/222 |
| 4,591,049 | 5/1986 | Walter et al. | 206/222 |
| 4,682,689 | 7/1987 | Pereira et al. | 206/222 |
| 5,791,466 | 8/1998 | Tsals | 206/222 |
| 5,884,759 | 3/1999 | Gueret | 206/222 |

*Primary Examiner*—Kevin Shaver
*Assistant Examiner*—David Deal
*Attorney, Agent, or Firm*—Richard M. Goldberg

[57] ABSTRACT

A cartridge containing two liquids, includes a first elongated cylindrical housing having a first end and a second opposite end; a second elongated cylindrical housing having a first end and a second opposite end; the first and second elongated housings being connected together in a lengthwise direction thereof at the first ends thereof and being slidable relative to each other in said lengthwise direction; a first pressure stopper fitted at the second end of the first elongated housing, the first pressure stopper having a central weakened zone which may be crossed when the cartridge is closed; a second pressure stopper fitted at the second end of the second elongated housing, the second pressure stopper having a central weakened zone which may be crossed when the cartridge is closed; a longitudinal needle with thin walls and a sharpened end, provided at the first end of the first elongated housing; a tearable membrane fitted to the first half of the second elongated housing adjacent the end of the needle; and a removable seal positioned around the first ends of the first and second elongated housings to prevent sliding movement of the first and second elongated housings relative to each other to prevent mixing of two liquids contained in the respective elongated housings of the cartridge.

8 Claims, 2 Drawing Sheets

CARTRIDGE CONTAINING TWO LIQUIDS

BACKGROUND OF THE INVENTION

The present Invention refers to a cartridge containing two liquids, that has been designed specially to simplify the mixture of both liquids whenever required as well as the perfect closure of the unit before, as well as after its use.

The cartridge subject of this invention will be preferably used within the pharmaceutical and hospital field, being especially designed to be used to contain two liquid products in its interior, a basic and an activator solution, which should only be mixed at the moment of use. For this reason they are perfectly separated in the interior of the container until required for use at which time they are mixed without any need to touch the products.

SUMMARY OF THE INVENTION

Containers for this purpose are already known on the market and there are, in fact, several solutions; for instance, bottles with a double recipient that enable the mutual mixing of the products contained in the interior. However, the system that constitutes the base of the present invention provides notable advantages over those currently used since by simply cutting a separation membrane, which takes place upon removing a seal, an outlet is opened which interconnects the two interior chambers of the cartridge. Each of these chambers contains one of the products to be mixed. The mixture of the two products may then take place by injecting water into one of the ends so that it passes through and draws first one of the liquids, and then the other, allowing exit of the mixture through the other end of the cartridge.

This purpose is achieved by a cartridge that is made up of two halves. One end of these two halves is closed by a pressure seal with areas of lesser thickness that enable water to pass through, as mentioned above. The other end of one of the cartridges is closed by a long fine-edged tube that comes into contact with a membrane fitted to the opposite half. The outer area between the two cartridges has a seal which, while in position, prevents the sharpened prolongation of one of the halves from pressing against the membrane described above.

At the moment in which the liquids contained in the interior of each one of the halves of the cartridge are to be mixed in preparation for use, it is only necessary to remove the seal and, so allow one of the cartridges to advance on the other, so that the sharpened extreme of the first cartridge strikes against the membrane and breaks it to produce complete communication between both cavities of the cartridge and, therefore, enabling the liquids contained in each cavity to intermingle until obtaining a perfect mixture by using as a vehicle, for example, pressurised water originating from the outside.

One of the possible uses of the cartridge being claimed is to contain the liquids used in kidney dialysis.

BRIEF DESCRIPTION OF THE DRAWINGS

In order to further clarify the explanation the present report is accompanied by a sheet of drawings showing, as an illustrative example only and not in any way limitative, the design of a cartridge containing two liquids, according to the principles of the claims.

In the drawings.

DETAILED DESCRIPTION

Figure 1:
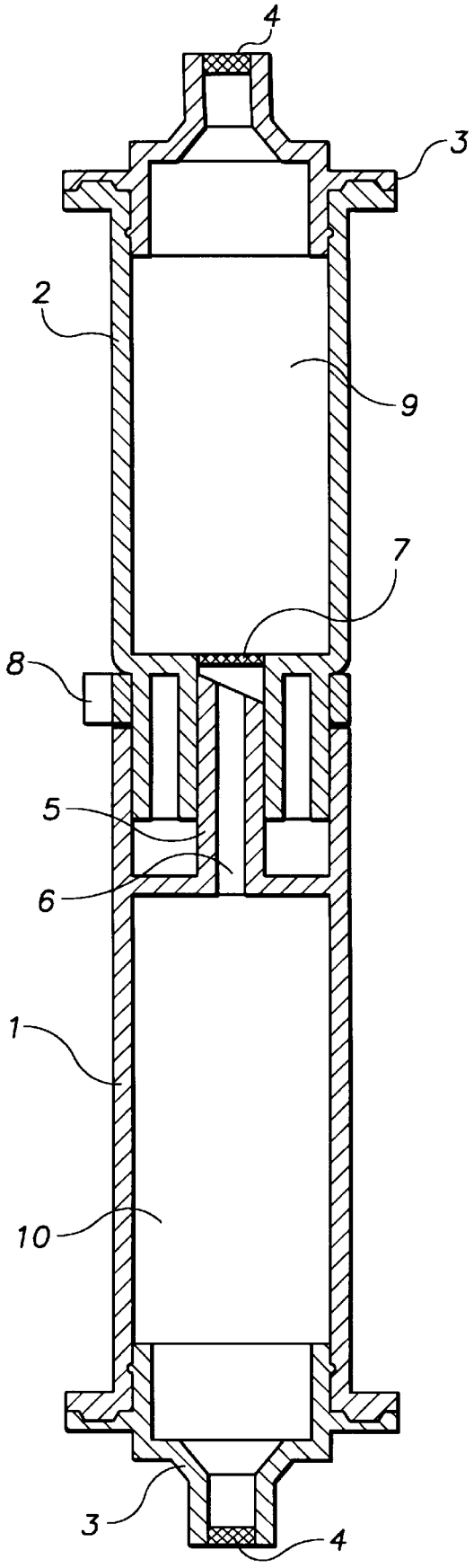
FIG. 1 shows a section drawing of the cartridge containing two liquids, as per the present invention.
Figure 2:
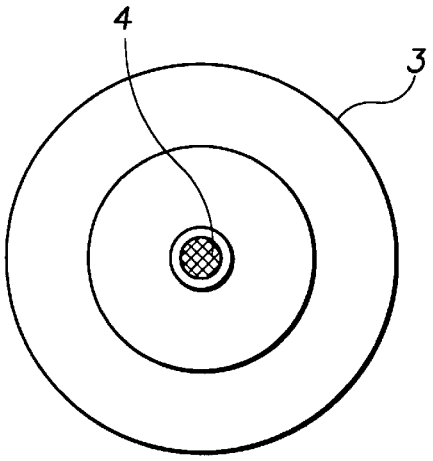
FIG. 2 is a top view of the same cartridge.

As shown in the drawings on the attached sheet, the cartridge containing the two liquids consists of two cylindrical halves -1- and -2-, connected lengthways, and both closed at one end by openings -3-. These openings have an upper thinner membrane -4- which can be broken. Both halves are connected together in the central area, in such a way that one of them contains a longitudinal cylindrical zone -5- hollow internally at -6- and with fine edges, while the opposite half has a membrane -7- which is in contact with the end of the cylindrical zone -5-. There is also an outer peripheral zone of the cartridge, located between both halves -1- and -2-, fitted with a seal -8- which, while the cartridge is not used remains fixed in position.

Figure 3:
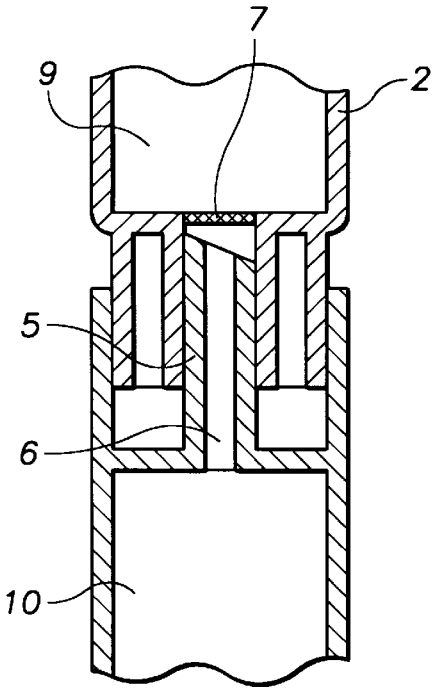
FIGS. 3 and 4 show details in elevation of the zone of union between the two halves of the cartridges, in the positions prior to and after breaking the seal, respectively.
Figure 4:
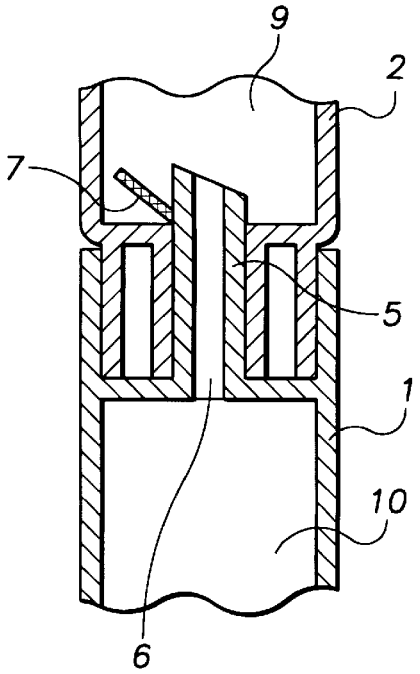

Close observation of FIGS. 3 and 4 using the numbers indicated above will enable a better understanding of the way in which the cartridge, subject of the claims, is used.

FIG. 3 shows the position of the set of two cartridges when not in use. The only difference between this and FIG. 1 is that the seal -8- has already been removed. This enables the two halves -1- and -2- to close on each other during operation. This has not yet taken place in FIG. 3.

The approximation between both halves has occurred in FIG. 4, and it is possible to see how the thin needle -5- fitted to one half -1-, has struck against the membrane -7-, puncturing it and enabling the liquids -9- and -10-, maintained perfectly separated in the interior of each of the mentioned halves to now be mixed. This operation involves a certain difficulty due to the narrowness of the hole -6- of the part -5- but which increases in speed by using suitable devices allowing water under pressure to pass through the weakened membrane -4-. The outlet of the water draws the liquids -9- and -10- now completely mixed, through the central membrane -4- of the opening -3- at the opposite end.

What is claimed is:

1. Cartridge containing two liquids, comprising:

a first elongated housing having a first end and a second opposite end;

a second elongated housing having a first end and a second opposite end;

the first and second elongated housings being connected together in a lengthwise direction thereof at the first ends thereof and being slidable relative to each other in said lengthwise direction;

a first opening at the second end of the first elongated housing;

a first central membrane which can be broken, at the first opening;

a second opening at the second end of the second elongated housing;

a second central membrane which can be broken, at the second opening;

a longitudinal needle with thin walls and a sharpened end, provided at the first end of the first elongated housing;

a tearable membrane fitted to the first end of the second elongated housing adjacent the end of the needle; and a removable seal positioned around the first end of at least one of the first and second elongated housings to prevent sliding movement of the first and second elongated housings relative to each other to prevent mixing of two liquids contained in the respective elongated housings of the cartridge.

2. Cartridge according to claim 1, wherein said elongated housings each have a cylindrical configuration.

3. Cartridge according to claim 1, wherein said needle and said tearable membrane are located centrally of the first ends of the first and second elongated housings, respectively.

4. Cartridge according to claim 1, wherein said first end of said second elongated housing includes at least one guide, and said first end of said first elongated housing is slidable along said at least one guide in said lengthwise direction.

5. Cartridge according to claim 4, wherein said at least one guide includes an inner guide positioned around said needle and through which said needle can slide in said lengthwise direction.

6. Cartridge according to claim 4, wherein said at least one guide includes an outer guide around which an outer wall of said first elongated housing can slide in said lengthwise direction.

7. Cartridge according to claim 1, wherein said tearable membrane is positioned around an outer wall of said second elongated housing adjacent said first end thereof, such that said first end of said first elongated housing abuts against said tearable membrane when said first elongated housing is forced in said lengthwise direction.

8. Cartridge according to claim 7, wherein said outer wall of said second elongated housing includes a reduced diameter portion adjacent said first end thereof, and said tearable membrane is positioned around said reduced diameter portion.

* * * * *